United States Patent [19]

Rolf et al.

[11] Patent Number: 4,594,735

[45] Date of Patent: Jun. 17, 1986

[54] COMBINATION PONCHO AND TENT

[76] Inventors: Gerald Rolf, 4622 Holland St., Wheatridge, Colo. 80033; John C. Wickersheim, 4325 Easley Rd., Golden, Colo. 80401

[21] Appl. No.: 815,947

[22] Filed: Jan. 3, 1986

[51] Int. Cl.[4] ..... A41D 3/08

[52] U.S. Cl. ..... 2/89

[58] Field of Search ..... 2/89; 135/95, 901

[56] References Cited

U.S. PATENT DOCUMENTS

| | | | |
|---|---|---|---|
| 1,193,443 | 8/1916 | Swan | 2/89 |
| 1,895,911 | 1/1933 | Bosson, Jr. | 2/89 |
| 2,093,889 | 9/1937 | Horn | 2/89 |
| 2,745,105 | 5/1956 | Schaefer | 2/89 |
| 3,837,006 | 9/1974 | Laseman | 2/89 |

*Primary Examiner*—Doris L. Troutman

[57] ABSTRACT

A combination poncho and tent is formed by attaching the larger end of a tapered sleeve of material to one of the sheets of a conventional poncho. In its collapsed state, the entire sleeve is secured to the poncho for storage by means of a pocket in the poncho or a flap of material that folds over the collapsed sleeve.

10 Claims, 6 Drawing Figures

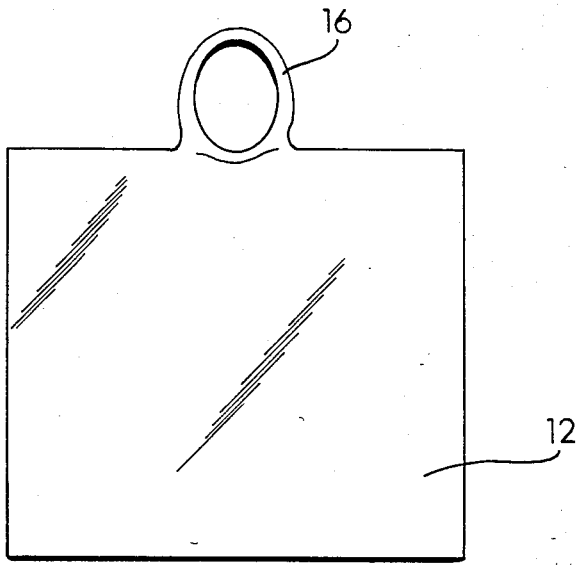
FIG. 2
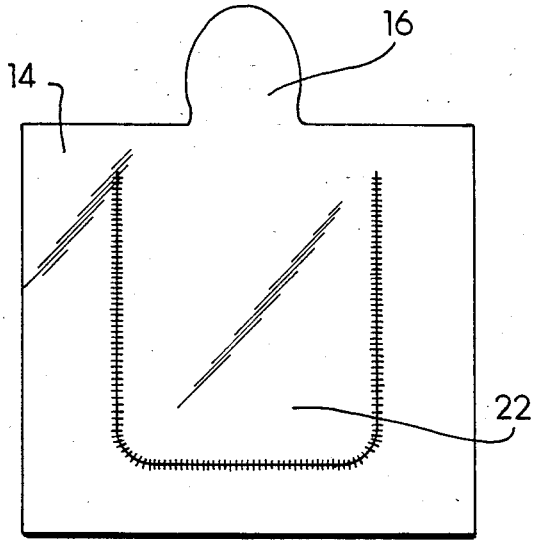
FIG. 3
FIG. 4
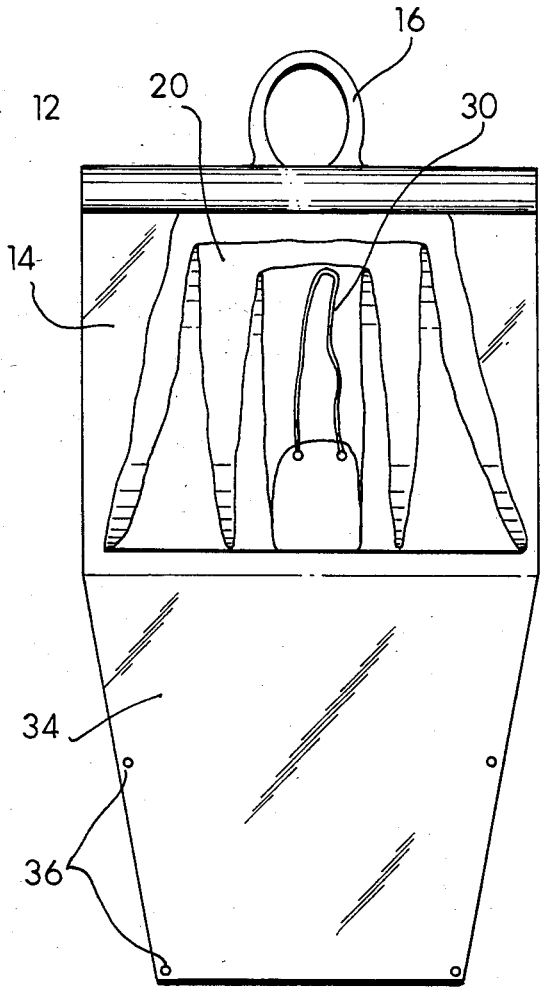

COMBINATION PONCHO AND TENT

BACKGROUND OF THE INVENTION

1. Field of the Invention

The present invention relates to the general field of hiking and camping apparel and equipment. More specifically, the present invention involves a poncho that can also be used as an individual tent.

2. Prior Art

In the past any number of types of ponchos and tents have been used. Only a few references involve an effort to combine these functions in a single article. In some of these references, the "tent" is little more than an effort to increase the effectiveness of an ordinary poncho by tailoring the poncho to more closely encapsulate the body of the wearer. This approach may increase the effectiveness of the poncho, but does not result in a tent that is convenient for either camping or sleeping. In other references, a poncho is fabricated from a piece of material that can also be used to form a section of a tent. Two or more of these ponchos can then be pieced together to form a single tent.

The present invention overcomes these limitations by offering a complete, fully-enclosed individual tent that is large enough to contain a standard air mattress.

SUMMARY OF THE INVENTION

The present invention comprises a combination of a poncho and tent. In the preferred embodiment, the tent comprises a tapered sleeve of collapsible material having its larger end attached to one of the sheets of the poncho. Means are provided for securing the tapered sleeve in its folded state to the poncho.

One principal purpose of the present invention is to provide a light-weight tent that can be conveniently worn and carried as part of the poncho.

Another principal purpose of the present invention is to provide a complete tent as part of the poncho that is sufficiently large and spacious to be comfortable for sleeping or camping by an individual.

Yet another purpose of the present invention is to provide a combined poncho and tent in which it is possible to change from one configuration to the other with a minimum amount of time and effort.

DESCRIPTION OF THE DRAWINGS

FIG. 2 is a front view of the poncho showing the front sheet and hood of the poncho.

FIG. 3 is a rear view of the poncho showing the back of the hood and the back sheet of the poncho, including the flap or door through the back sheet of the poncho that forms the entrance to the tent.

FIG. 4 is another front view of the poncho with the front sheet rolled up, and showing the collapsed tapered sleeve of the tent folded against the interior surface of the back sheet of the poncho. The flap used to secure the folded sleeve to the back sheet of the poncho is also shown folded downward from the bottom of the back sheet of the poncho.

DETAILED DESCRIPTION OF THE INVENTION

Figure 1:
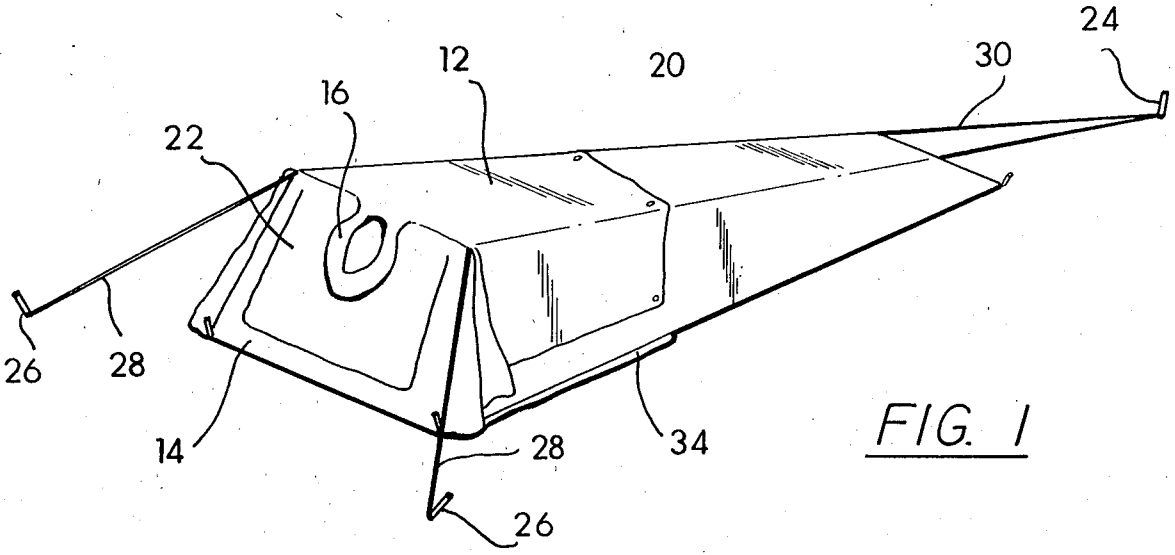
FIG. 1 is an isometric view showing the tent in its fully assembled state.

Turning to FIG. 1, an isometric view is shown of the present invention assembled as a tent. In contrast, FIGS. 2–4 show the present invention configured as a poncho with the body of the tent collapsed and folded for storage. The major components of the poncho are the front and back sheets 12 and 14 and a hood 16 of generally conventional configuration. In fact, the present invention was specifically devised so that a conventional poncho could be retrofitted or adapted.

As shown in FIGS. 1 and 4, the body of the tent consists of an axially tapered sleeve 20 of collapsible material, such as canvas, cloth, or a thin sheet of plastic. The opening at the larger end of the sleeve is attached to the poncho. In the preferred embodiment, a flap or door 22 through one of the sheets of the poncho serves as an entrance to the tent. Alternatively, one of the entire sheets of the poncho could serve as a flap over the opening at the larger end of the sleeve.

In the event of inclement weather, the entrance flap can be secured about the opening of the sleeve by means of a zipper, snaps, or velcro strips. In pleasant weather the entrance flap can either be rolled up, folded out of the way, or suspended in front of the opening to provide a shaded area.

In another alternative embodiment, the tapered sleeve is entirely detachable from the poncho. The tapered sleeve can be separately used as a tent independent of the poncho. In this case an additional flap attached near the larger end of the sleeve acts as a door or entrance flap for the tent.

Virtually any type of tent could conceivably be attached to the poncho. However, the tapered sleeve 20 shown in FIGS. 1, 4, 5, and 6 is superior in terms of ease of use, comfort, compact size and weight.

When the invention is configured as a tent, a number of poles 40 support the peak of the tapered sleeve near its larger end. As an alternative to conventional one-piece tent poles, light-weight folding, telescoping, or segmented poles can be used for this purpose. The tent poles can be stored in a small pocket or pouch in the poncho or stored separately when the tent is not in use. At least one tent pin 24 fastens the tapered end of the sleeve to the ground. A number of tent pins 26 and guidelines 28 located foreward of the poles provide opposing tension to support the poles and the tent in the assembled state. In the embodiment shown in FIG. 5, two tent poles 40 are employed to support the larger end of the tapered sleeve. These poles are located on either side of the entrance to the tent. A single cord 30 is fastened at two places to the tapered end of the sleeve. A single tent pin 24 used to apply tension to this loop of cord creates two ridges running the length of the tapered sleeve to the tops of the poles. This is balanced by opposing tension applied by two guidelines 26 and a number of tent pins 28 located forward of these posts.

The tent is disassembled by removing the tent pins and releasing the guidelines. The poles are then easily removed for storage. The tapered sleeve can be folded or rolled into a very compact form against the interior surface of the poncho sheet. The tapered sleeve is secured in place by any number of means, including snaps, velcro, straps, or a pocket in the poncho. In the preferred embodiment shown in FIG. 4, a storage flap 34 is attached to the poncho sheet, and can be folded over the collapsed sleeve and secured by snaps 36 or a zipper.

One edge of the flap is secured to the poncho. The free end of the storage flap folds over the collapsed tapered sleeve and is removably secured to the poncho by means such as by snaps, velcro, or a zipper.

Figure 5:
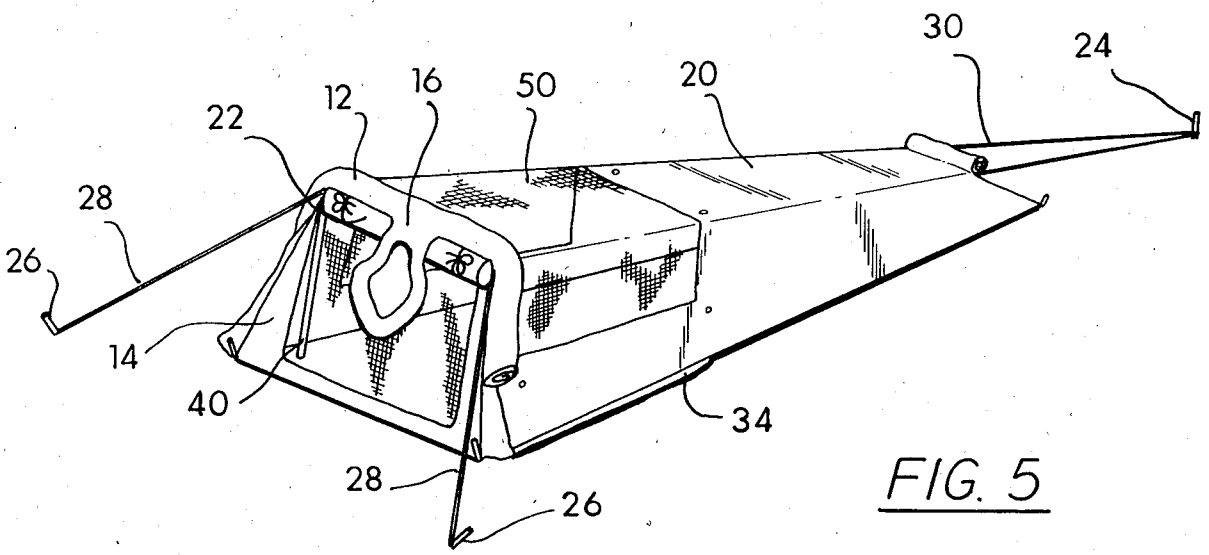
FIG. 5 is another isometric view of the assembled tent showing mosquito netting incorporated as part of the tent to enhance air circulation.
Figure 6:
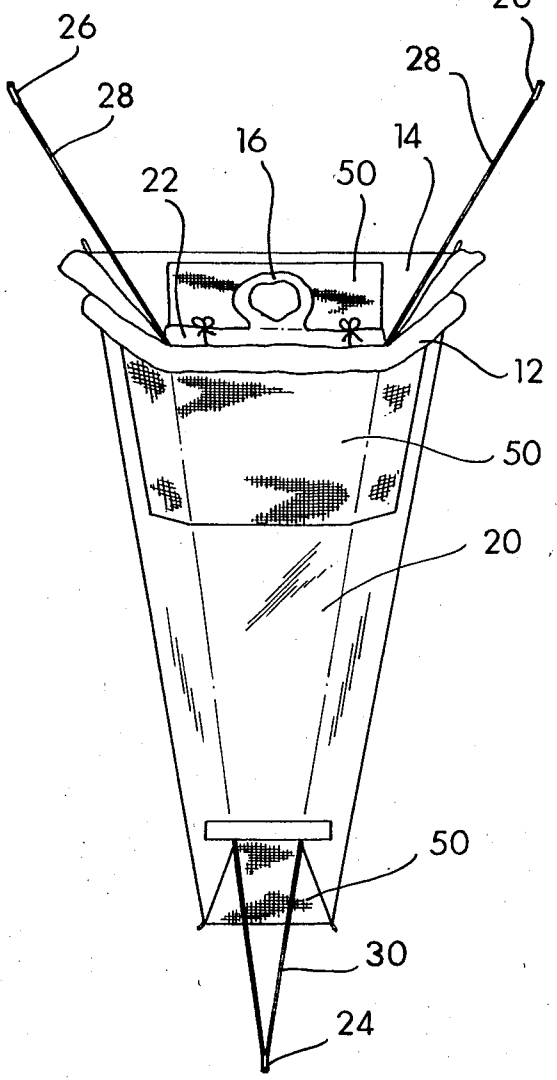
FIG. 6 is a top view showing the assembled tent of FIG. 5.

As shown in FIGS. 1 and 5, the storage flap lies under the tapered sleeve when the invention is configured as a tent. The bottom surface of the tapered sleeve normally acts as a ground cover for the user. The storage flap provides a second layer under the upper body of the user.

Alternatively, the storage flap can be made entirely detachable from the poncho. By adding an opening for the user's head (and possibly a hood), the storage flap can be used separately as a miniature poncho while assembling or disassembling the tent.

FIG. 5 shows how insect netting or screening 50 can be added to improve air circulation through the tent. Netting can be used across the opening at the larger end of the tapered sleeve, or alternatively as a secondary door zippered inside the entrance flap. Netting can also be substituted for a section of the wall of the tent near the tapered end of the sleeve. This allows air flow through the entire length of the tent. Another embodiment substitutes netting for those sections of the top and side surfaces of the tapered sleeve near its larger end that would normally be covered by the front sheet 12 of the poncho. By adjusting the position of the front sheet of the poncho over the netting, the circulation of air can be regulated.

We claim:

1. A combination tent and poncho comprising:

(a) A poncho;

(b) A tent comprising a collapsible tapered sleeve with its larger end attached to the surface of the poncho; and (c) Means for securing the tent in its collapsed state to the poncho.

2. The combination tent and poncho of claim 1, further comprising a number of tent poles supporting the peak of the tent near its larger end.

3. The combination tent and poncho of claim 2, further comprising:

(a) A number of rear guidelines extending from the tapered end of the tent to ground, and exerting a tensile force through the tent to the upper ends of the tent poles; and (b) A number of forward guidelines exerting an opposing tensile force to the upper ends of the tent poles.

4. The combination tent and poncho of claim 2 wherein each of the tent poles comprises a series of collapsible telescoping members.

5. The combination tent and poncho of claim 1 further comprising an opening through the surface of the poncho suitable for use as an entrance into the tapered sleeve.

6. The combination tent and poncho of claim 1 wherein a number of sections of the wall of the tapered sleeve have been replaced with insect netting.

7. The combination tent and poncho of claim 6 wherein a section of the wall of the tapered sleeve, near its larger end that can be covered by the poncho sheet, is replaced with insect netting.

8. The combination tent and poncho of claim 6 wherein a section of the wall at the tapered end of the sleeve is replaced with insect netting.

9. A combination tent and poncho comprising:

(a) A poncho;

(b) A tent comprising a collapsible tapered sleeve with its larger end attached to the surface of the poncho; and (c) A securing flap, one edge of which is attached to the poncho surface, that folds over the tapered sleeve in its collapsed state, with the free end of the flap removably fastened to the poncho.

10. A combination tent and poncho comprising:

(a) A poncho;

(b) A tent comprising an axially tapered collapsible sleeve with its larger end attached to the interior surface of the poncho;

(c) An opening through the poncho into the tapered sleeve;

(d) A securing flap attached to the poncho, that folds over the tapered sleeve in its collapsed state with the free end of the flap removably fastened to the poncho;

(e) A number of tent poles for supporting the peak of the tent near its larger end, in its assembled state;

(f) Means for securing the tapered end of the tent to ground, in its assembled state.

* * * * *